US006343438B1

(12) United States Patent
Boldt

(10) Patent No.: US 6,343,438 B1
(45) Date of Patent: Feb. 5, 2002

(54) DOOR FRAME AND KIT

(75) Inventor: Gary L. Boldt, Green Bay, WI (US)

(73) Assignee: Bay Industries, Inc., Green Bay, WI (US)

( * ) Notice: Subject to any disclaimer, the term of this patent is extended or adjusted under 35 U.S.C. 154(b) by 579 days.

(21) Appl. No.: 08/674,911

(22) Filed: Jul. 3, 1996

(51) Int. Cl.[7] ..... E06B 1/04
(52) U.S. Cl. ..... 49/504
(58) Field of Search ..... 52/210, 202; 49/504, 49/505

(56) References Cited

U.S. PATENT DOCUMENTS

| | | | | |
|---|---|---|---|---|
| 2,755,895 | A | 7/1956 | Walterman et al. | 189/46 |
| 4,308,692 | A | 1/1982 | Rumble et al. | 49/504 |
| 4,509,294 | A | 4/1985 | Boilard | 49/504 |
| 4,531,337 | A | 7/1985 | Holdiman | 52/217 |
| 5,375,383 | A | 12/1994 | Lin et al. | 52/217 |
| 5,437,130 | A | 8/1995 | Raynak | 52/210 |

*Primary Examiner*—Peter M. Cuomo
*Assistant Examiner*—Stephen Vu
(74) *Attorney, Agent, or Firm*—Wilhelm Law Service; Thomas D. Wilhelm

(57) ABSTRACT

Door frame kits to be assembled into door frames and door frames assembled from such kits. A door frame kit includes a top member, and first and second side members. Open edges are defined along substantially the full lengths of extruded metal structures of the top and side members, and communicate with cavities in the respective extruded metal structures. Each cavity has interiorly-facing side walls extending along substantially the full lengths of the extruded metal structures. Substrates are received in the respective cavities of the top and side members. The substrates extend outwardly of the cavities through the respective open edges. The substrates structurally reinforce the extruded metal structures between the side walls along substantially the full lengths of the extruded metal structures. Preferably the extruded metal structures are extruded aluminum structures and the substrates are wood. The door frame kits, and door frames, are especially advantageous for framing garage door openings in garages suitable for storage of motor vehicles such as automobiles, trucks, and the like.

34 Claims, 4 Drawing Sheets

DOOR FRAME AND KIT

FIELD OF THE INVENTION

This invention relates to door frame kits to be assembled into door frames, to door frames assembled from such kits, and to methods for assembling and installing such door frames.

BACKGROUND OF THE INVENTION

This invention pertains specifically to prefabricated door frames and easily assembled door frame kits for use in the construction of a building.

When installing a door frame into a door opening in a building, it is desirable to have a strong, durable frame which is either prefabricated or easily assembled on the construction site. In any event, the door frame or its precursor should be easily and economically transported to the construction site. In the case of a larger door (e.g. garage door) it is often impractical to ship a prefabricated door frame assembly due to its overall size and bulkiness.

Typical (e.g. residential) garage door frames for non-commercial use comprise wood framing and support members. Thus the typical door opening built to receive a door frame is comprised of wood. Therefore, a suitable door frame should be easily mounted to the wood door opening.

In order for door frames to withstand normal deteriorating effects caused by exposure to weather or minor abrasions or other abuse by vehicles, bicycles, or the like, a door frame should have a protective outer layer which maintains the appearance and structural integrity of the door frame in the presence of such forces. Thin metal cladding which is typically fabricated about existing surface contours of, for example, a wood frame at the construction site provides protection from weathering effects, but due to its necessary characteristic of minimal resistance to bending, does not adequately protect the door frame from deforming forces caused by normal abuse of garage door frames, such as minor collisions, abrasions, or the like.

It is an object of this invention to provide a door frame kit whose members are comprised of metal extruded structures (e.g. aluminum) and whose members optionally receive reinforcing substrates (e.g. wood), with the metal extruded structure providing strength and protection to the door frame, and the substrate providing substantial support to the metal extruded structure and assisting in mounting of a door frame assembled from the kit in the door opening. The door frame kit may be prefabricated to form a door frame. However, for larger door openings, the kit is preferably shipped disassembled, and is easily assembled into the door frame assembly at the building site. In either case, the substrate is received in the extruded metal structure during the manufacturing process and is present before the door frame or door frame kit is shipped to the building site.

It is a further object of this invention to provide a novel weather strip assembly which covers exposed portions of door frame substrate material to provide a door frame assembly having a maintenance-free exterior surface.

SUMMARY OF THE DISCLOSURE

The invention is generally directed at door frames, door frame kits, and methods for assembling and installing the same. In preferred embodiments, a door frame kit includes a top member, a first side member, and a second side member. The top and side members comprise elongate extruded metal structures having lengths corresponding substantially with the respective width and height of a door opening into which a door frame made with the kit can be inserted. An open edge is defined along substantially the full lengths of the extruded metal structures of the top and side members, and communicates with cavities in the respective extruded metal structures. Each cavity has a plurality of walls, including interiorly-facing side walls extending along substantially the full lengths of the extruded metal structures. First, second, and third substrates are received in the respective cavities of the first and second side members, and the top members. The substrates have widths extending outwardly of the cavities through the respective open edges. The substrates structurally support and reinforce the extruded metal structures between the side walls along substantially the full lengths of the extruded metal structures, and typically fill the cavities.

Preferably the extruded metal structures are extruded aluminum structures and the substrates are wood.

The extruded metal structures may comprise first and second metal extrusions cooperatively secured together to form the overall coverings comprising the extruded metal structures. The first metal extrusion may include breakaway portions to allow adjustment of the width of first metal extrusion to accommodate the width of the respective substrate.

Additionally the extruded metal structure may be totally enclosed (e.g. no separate substrate element). In the totally enclosed embodiment, one or more support webs may extend across the cavity defined interior to the walls of the extruded metal structure to structurally reinforce the enclosed extruded metal structure along substantially the full length of the enclosed extruded metal structure.

Positioning strips may be mounted to the extruded metal structures for assisting in positioning the door frame into the door opening of a building, thereby positioning the door frame relative to the door opening and aligning the door frame with the outer wall of the building.

The door frame assembly may include weather strip assemblies mounted to the substrates and covering those portions of the substrates which extend from the extruded metal structures and which would otherwise be exposed to the weather in a typical building installation. This combination of extruded metal structures and weather strip assemblies results in substantially complete coverage of those portions of the substrates which would otherwise be exposed to weather, thereby providing a maintenance-free door frame.

A channel preferably defined in the weather strip assembly provides a mounting locus for mounting the weather strip assembly to the door frame substrate. A fastener cover may be mounted to the channel, along substantially the full length of the channel, to cover the channel and thereby enclose the channel to impede the intrusion of liquid and/or insects into the channel and to impede visual observation of the channel. A sealing strip is mounted to the mounting structure, and provides a weather seal between the door frame and a door mounted in the door frame.

The width of the door frame is defined in general by the length of the top member. In preferred embodiments, the length of the top member is at least 43 inches, and preferably is sufficient to enable the door frame to be used as a garage door frame.

Thicknesses of walls of the extruded metal structures are at least about 0.02 inch.

Figure 1:
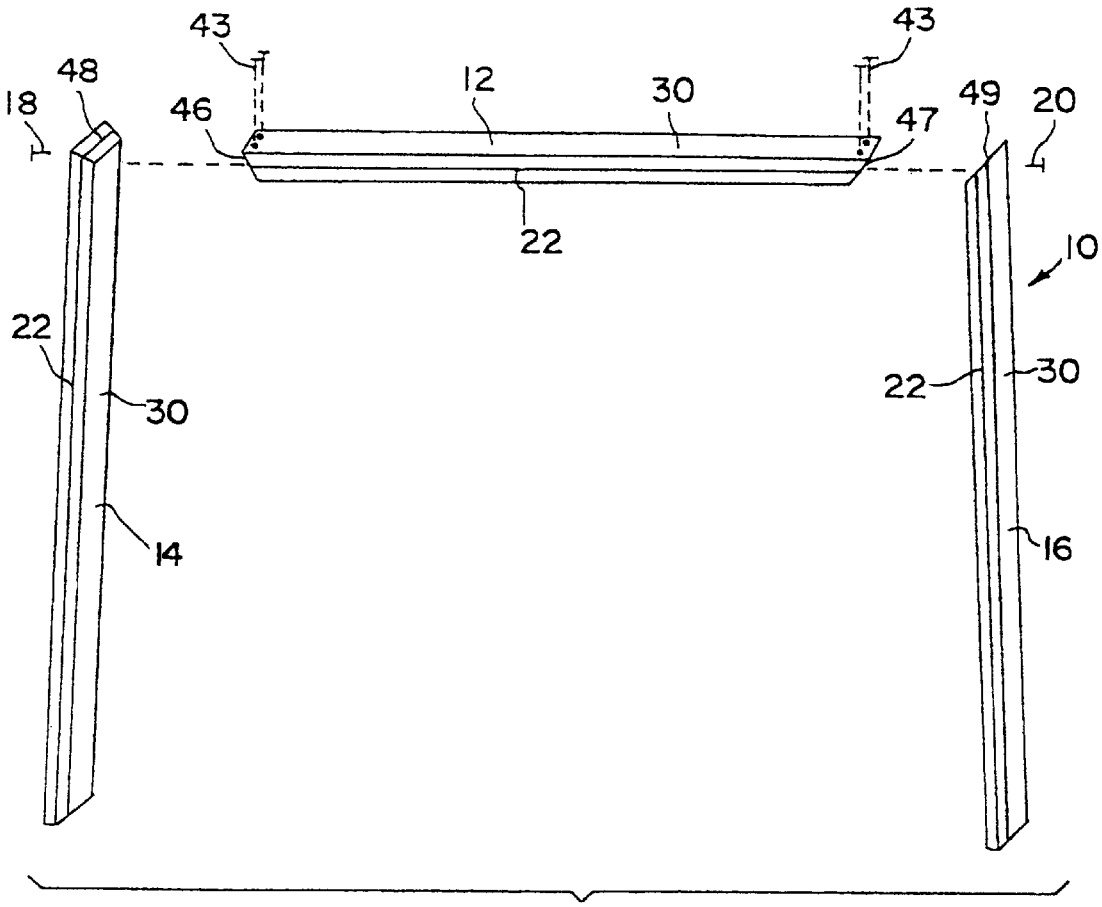
FIG. 1 shows an exploded pictorial view of a door frame kit of the invention.

It is to be understood that the invention is not limited in its application to the details of construction and the arrangement of the components set forth in the following description or illustrated in the drawings. The invention is capable of other embodiments or of being practiced or carried out in various ways. Also, it is to be understood that the terminology and phraseology employed herein is for purpose of description and illustration and should not be regarded as limiting. Like reference numerals are used to indicate like components.

DETAILED DESCRIPTION OF THE ILLUSTRATED EMBODIMENTS

Referring now by characters of reference to the drawings, FIG. 1 shows generally, a door frame kit 10 of the invention. Kit 10 includes a horizontal top member 12 to be mounted at opposing ends to left and right upstanding side members 14, 16 respectively. Mounting screws 18, 20, plus additional fasteners 43 and the like, are used to secure joinder of side members 14, 16 to top member 12.

Figure 2:
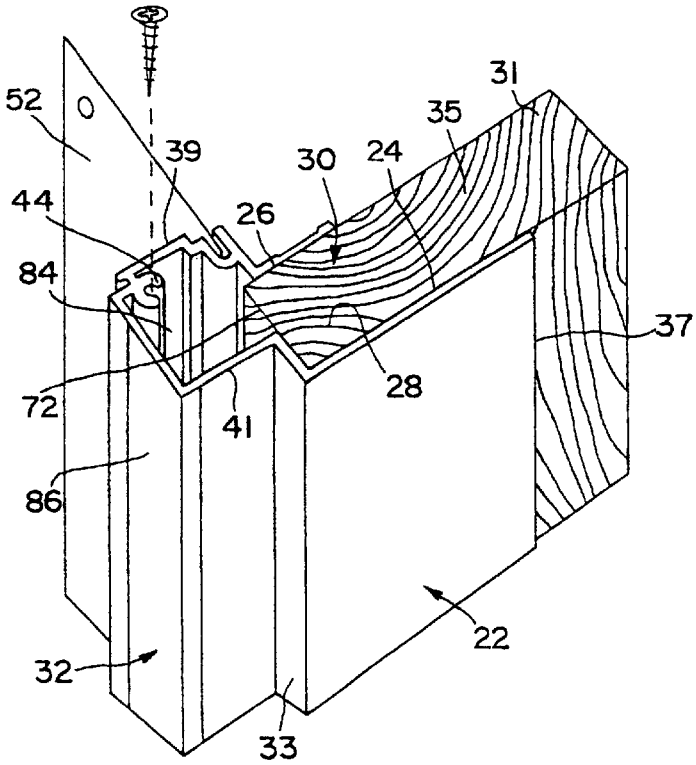
FIG. 2 shows a pictorial cross-section of a typical door frame kit top or side member, illustrating a one-piece metal extruded structure of the invention, and position of the substrate in the cavity.

Referring now to FIG. 2, the cross-section of a typical top or side member 12, or 14 or 16, is shown, and is substantially uniform along the length of the respective member. A typical such member comprises a metal extruded structure 22 having interiorly-facing side walls 24, 26 which define a cavity 28 therebetween.

Cavity 28 is generally defined between side walls 24 and 26, from butt wall 33 to the open edge 35 of the cavity at the outer edge 37. As defined herein, cavity 28 generally does not include the elongated opening 84 which extends the length of the extruded structure between stub walls 39, 41.

Figure 3:
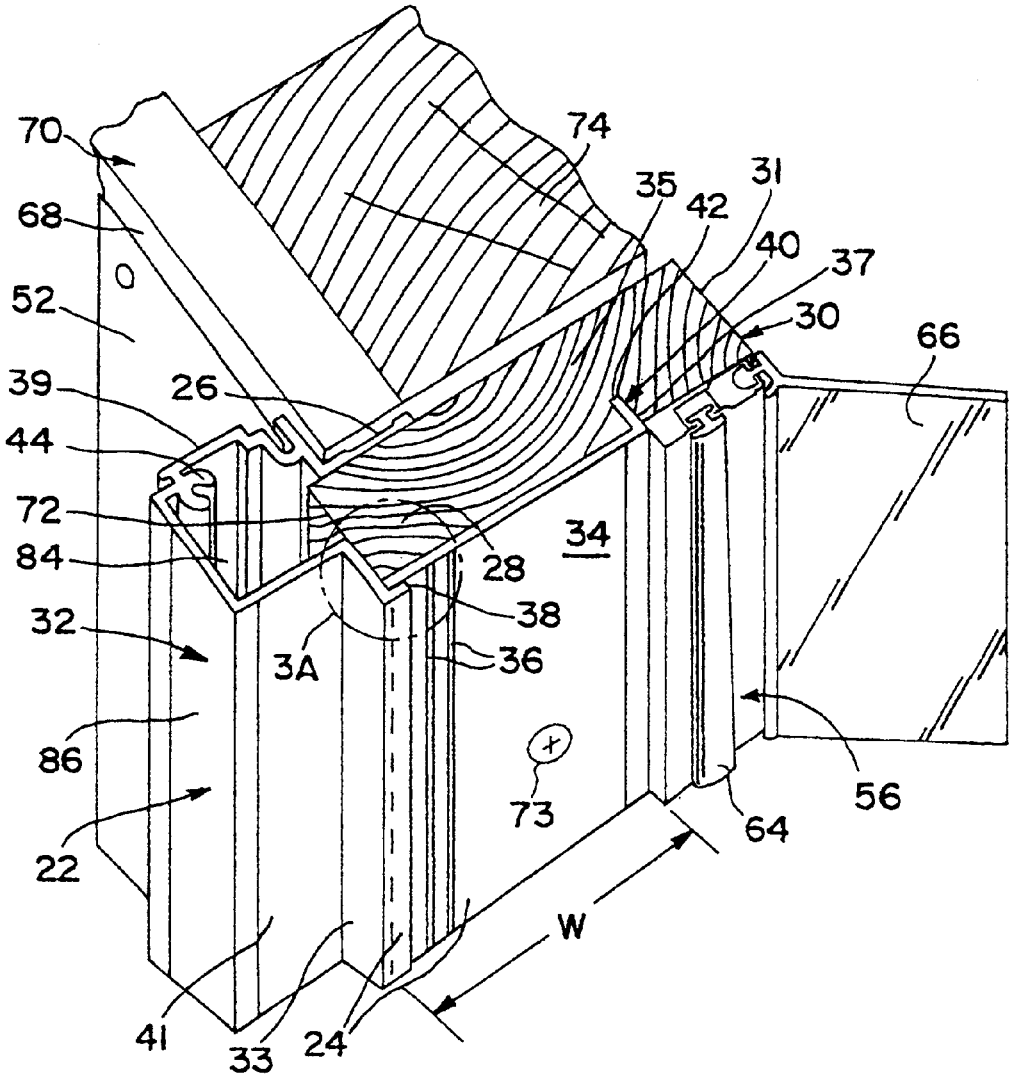
FIG. 3 shows a pictorial cross-section as in FIG. 2, illustrating a second embodiment, comprising a two-piece metal extruded structure of the invention.
Figure 3A:
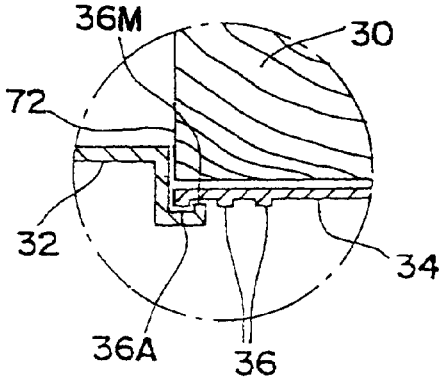
FIG. 3A is an enlarged plan view of a portion of the cross-section shown in FIG. 3 and taken at 3A in FIG. 3.

A substrate 30 is received in cavity 28. The substrate 30 is installed in the cavity 28 during the manufacture of the door frame kit 10 and is thus present when the door frame kit 10 is shipped from the kit manufacturing facility to e.g. the building site. Fasteners (e.g. nails or screws) can be used to aid in securing substrate 30 within the cavity 28 when so installed. Substrate 30 structurally reinforces the extruded metal structure 22. Preferably, substrate 30 substantially fills the portion of cavity 28 which is disposed between the respective opposing side walls 24, 26, providing its own e.g. compressive and bending resistances to compressive forces and bending forces, and combining together, with its own resistances, the resistances (e.g. bending and compressive resistances) of the opposing side walls 24, 26 of cavity 28. As seen in FIGS. 2 and 3, portion 31 of substrate 30 extends outwardly of the cavity 28, beyond outer edge 37.

In a second embodiment illustrated in FIG. 3 the metal extruded structure 22 comprises in combination a frame molding 32 as a first metal extrusion and a substrate cover 34 as a second metal extrusion. Substrate cover 34 includes a number of elongate interfacing ridges 36 including outermost interfacing ridge 38. During assembly of the respective top or side member, one or more ridges 36 can be intentionally broken away from the main body of substrate cover 34 in order to reduce the width "W" of the substrate cover 34 to accommodate the respective width of the substrate 30. If no such reduction is needed, or after such reduction has been made, the outermost interfacing ridge 36A on the substrate cover then interfaces with a corresponding ridge 36M on frame molding 32 whereby substrate cover 34 and frame molding 32 cooperate to form the 2-piece metal extruded structure 22.

In preferred embodiments, inwardly turned lip 40 on metal extruded structure 22 is inserted into, and interfaces with, cooperating groove 42 in substrate 30 to aid in positioning substrate 30 in cavity 28.

Metal extrusion 22 includes screw receiver channel 44, which facilitates positioning side members 14, 16 with respect to top member 12, and thereby facilitates mounting side members 14, 16, to top member 12. Screws 18, 20 extend through respective apertures (not shown) in side members 14, 16, and into screw receivers 44 in top member 12, thus positioning, and providing initial mounting, of the side members to the top member. Additional fasteners (e.g. screws) are used to secure the exposed portion of substrate 30 of top member 12 to the respective exposed portions of substrates 30 of the side member 14, 16 where the substrate 30 of top member 12 interfaces with the substrates 30 of side members 14, 16. Accordingly, side members 14, 16 are properly positioned with respect to top member 12 by screws 18, 20 and screw receiver 44, and are fully secured to each other by the additional fasteners 43, such as nails or screws.

Figure 4:
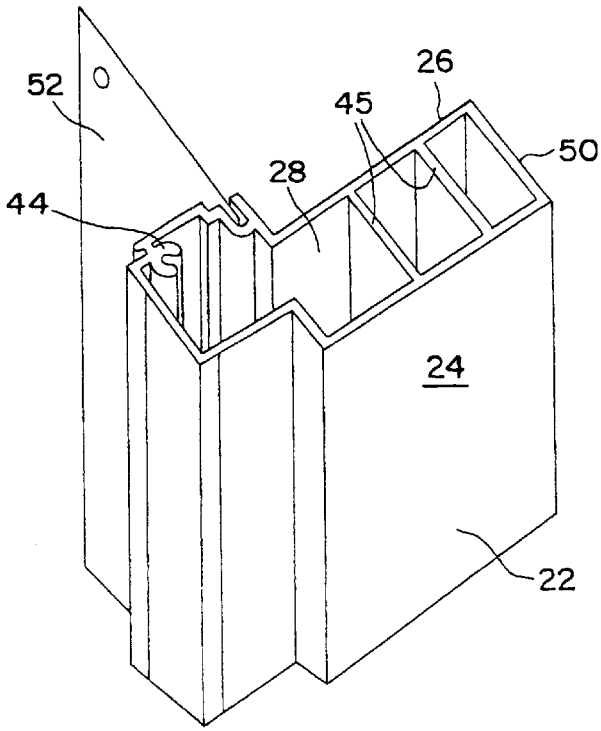
FIG. 4 shows a pictorial view as in FIG. 2, illustrating a third embodiment, comprising a fully-enclosed metal extruded structure of the invention.

A third embodiment of the extruded metal structure 22 is shown in FIG. 4. In this embodiment, the extruded metal structure 22 is enclosed. Namely, open edge 35 has been closed off. Side wall 26 is the same length as side wall 24, though equal lengths is not a limitation. The opening between side walls 24, 26 is closed off by end wall 50. At least one support web 45 (two support webs are shown) extends across cavity 28 between side walls 24, 26 to structurally reinforce the enclosed extruded metal structure along substantially the full length of the enclosed extruded metal structure 22. Appropriate aligned mounting holes (not shown) are provided through side walls 24, 26, for mounting the frame assembly to the door opening frame members, using conventional fasteners.

Given a door frame kit including top member 12 and side members 14, 16, and with respect to all embodiments, welding is generally not practiced in joining the extruded metal structure 22 of top member 12 to the respective extruded metal structures of side members 14, 16. Rather, screws 18 or the like, and screw receivers 44, are used in combination to position side members 14, 16 with respect to top member 12. Then additional fasteners 43, preferably removable fasteners, are used to fully secure side members 14, 16 to top member 12. Fasteners 18 and 43 can all extend through the side members into the top member, can all extend through the top member into the side members, or some can extend through the side members into the top member and some through the top member into the side members. The number and type of fasteners 43 can be readily selected by those skilled in the art.

In preferred door frame kits, the extruded metal structure 22 comprises an extruded aluminum structure. The thickness of the walls of the extruded metal structure help determine the degree to which the structure 22 resists deteriorating effects caused by exposure to weather or by physical abuse such as minor collisions or abrasions with vehicles, bicycles, or the like. As a second factor, the metal alloy composition can be selected for its rigidity and like properties providing resistance to physical abuse.

Compared to aluminum cladding whose contours are formed and applied at the construction site, about respective contours of an otherwise-installed wood frame, the extruded metal structure 22 of the invention provides greater strength and protection due to its greater thickness, its sharper corners, and greater rigidity and e.g. toughness of the alloys which can be selected because the extruded structure generally need not be bent during the assembly process or the installation process.

Addressing metallurgy, cladding material must be soft and bendable in order to perform the intended "cladding" function at e.g. the construction site. By contrast, extruded metal structure 22 rarely, if ever, needs to be bent at the construction site. Thus extruded metal structure 22 is preferably made with an alloy whose metallurgy inherently provides more rigidity, and more bending resistance, than the alloys from which cladding sheet metal is conventionally made.

For example, a preferred alloy for the extruded metal structures of the invention is a wrought aluminum alloy having AA designation 6063. The composition of Aluminum Alloy 6063 is illustrated below as ALLOY I. By contrast, a typical alloy for conventional cladding sheet metal is a wrought aluminum alloy having AA designation 3105. The composition of Aluminum Alloy 3105 is illustrated below as ALLOY II. In both ALLOY I and, ALLOY II, percentages are percent by weight.

| Element | ALLOY I Aluminum 6063 | ALLOY II Aluminum 3105 |
|---|---|---|
| Silicon | 0.2–0.6% | 0.0% |
| Iron | 0.35% | 0.7% |
| copper | 0.10% | 0.30% |
| Manganese | 0.10% | 0.30–0.8% |
| Magnesium | 0.45–0.9% | 0.20–0.8% |
| Chromium | 0.10% | 0.20% |
| Zinc | 0.10% | 0.40% |
| Titanium | 0.10% | 0.10% |
| Others | 0.15% | 0.15% |
| Aluminum | Remainder | Remainder |

Since no bending is required of the extruded metal structure to assemble the door frame kit or to install the door frame, the thickness of the walls of the extruded metal structure can be greater, significantly greater, than the thickness of known cladding material. Thus, the thickness of the walls of the extruded metal structure is at least about 0.02 inch. Preferably, the thickness of the walls of the extruded metal structure is at least about 0.04 inch. More preferably, the thickness of the walls (e.g. 24, 26) of the extruded metal structure is at least about 0.04 inch to about 0.05 inch. A highly desired thickness, which provides abuse resistance and relatively light weight, is about 0.062 inch.

Similarly, the bending resistance of an extruded sheet of Alloy I is greater than the bending resistance of an equal-thickness sheet of cladding sheet of Alloy II. Other aluminum alloys are acceptable so long as they have the improved bending resistance, along with susceptibility to being extruded. The combination of greater inherent bending resistance of the alloy, plus opportunity to use greater thicknesses of the extruded structure as compared to the cladding sheet, thus provides a metal covering on the frame substrate which provides abuse resistance superior to the abuse resistance available from any cladding material which may be applied at the construction site.

Rigidity and thickness of cladding sheet is, of course, limited by the fact that the cladding must be receptive to being bent as part of the on-site installation process.

Certain aspects of the invention are seen when the door frame kit has been assembled to form a door frame assembly 54. As seen in FIG. 1, the ends 46, 47 of the top member and the respective ends 48, 49 of the side members are cut at cooperating angles, preferably angles of about 45 degrees, to facilitate forming mitered square corner joints when the members are mounted to each other. The joints formed where the top 12 and side 14, 16 members are mounted to each other are preferably sealed with a sealing material (e.g. caulk) to impede the intrusion of liquid and/or insects into the joint.

The door frame kit 10 of the invention, including all embodiments shown, is preferably assembled to make a respective door frame assembly 54 prior to inserting the door frame assembly into the door opening of the building. By corollary, the members of door frame kit 10 generally do not interface with, or interact with, the door opening while the door frame kit is being assembled to make the door frame assembly.

After the kit has assembled, the completed door frame assembly 54 is inserted, as a unit, into the door opening of the building 53. The portions of the substrates 30 which extend outwardly from the cavity 28 provide mounting loci for mounting the door frame assembly to the material forming the door opening of the building (e.g. wood framing). Nails, screws, or the like are typically inserted through substrate 30 and into the material forming the door opening (e.g. wood framing) to secure the door frame assembly to the building, in the door rough opening.

To aid in positioning the assembled door frame made from the door frame kit 10 within the door frame opening, a positioning strip 52 may be mounted to the extruded metal structure 22 for interfacing with an outer surface of a member of an outer wall structure of the building, for thus positioning the door frame assembly within the door opening and aligning the door frame assembly with the outer wall of the building. Typically, positioning strip 52 interfaces with the outer surface of sheathing or like interior layer of the wall, interiorly of the outer layer (e.g. siding) of the wall structure.

Figure 5:
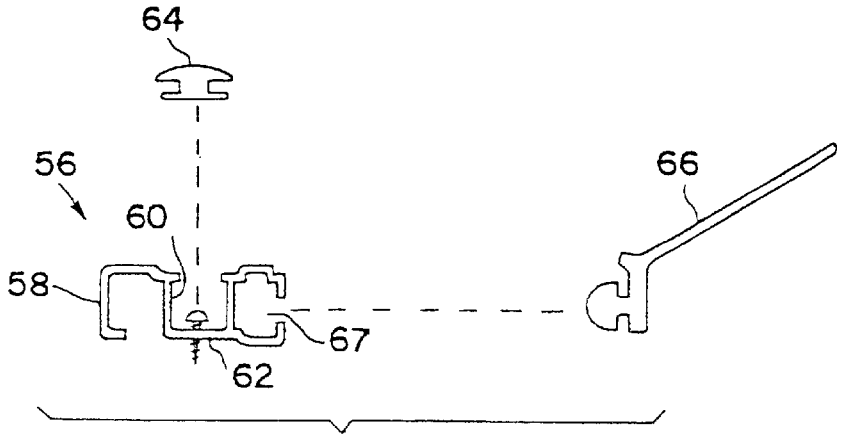
FIG. 5 shows an exploded view of a novel weather strip assembly of the invention.

The extruded metal structure 22 aids in protecting, from weather and the like, that portion of substrate 30 which is received in the cavity 28, while leaving uncovered that portion of substrate 30 which extends from the cavity, thus leaving the uncovered portion more susceptible to deteriorating weather and like effects. To further protect the door frame assembly 54, a weather strip assembly 56 as shown in FIGS. 3 and 5 can be mounted to the portion of the substrate 30 extending outwardly from the cavity 28 which will be exposed to the weather in a typical building installation, for example outwardly from outer edge 37. Use of weather strip assembly 56 results in essentially complete coverage of those portions of the substrate which would otherwise be exposed to weather, such that extruded metal structure 22 and weather strip assembly 56, in combination, provide a maintenance-free door frame.

A preferred weather strip assembly 56 of the invention is seen in FIG. 5. In weather strip assembly 56 in general, an elongate mounting structure 58 has a channel 60 along substantially the full length of the mounting structure 58. The mounting structure can be mounted by screws, nails, or the like to a top or side member 12, 14, 16. Back wall 62, opposite channel 60, interfaces with the respective top or side member.

Fastener cover 64 is mounted to the channel 60 after weather strip assembly 56 has been mounted to the door frame, thus covering the channel 60 and enclosing the channel 60 to impede intrusion of e.g. liquid and insects into channel 60. Fastener cover 64 also increases the visual appeal of the weather strip assembly 56 by impeding visual observation of the channel 60.

Sealing strip 66 is mounted to mounting structure 58 at channel 67 to provide a weather seal between the door frame 54 and the door which operates within the door opening defined by door frame 54. Typically, fastener cover 64 and sealing strip 66 are polyvinyl chloride or other suitable polymeric material.

Typically, weather strip assemblies 56 are mounted to top and side members 12, 14, 16 after the top and side members have been joined to each other, although they can be mounted earlier.

While not limiting, preferred door frame kits or completed door frame assemblies of the invention are generally sized to serve as door frames for entry and egress of automobiles and light trucks of about e.g. 1 ton to about 5 tons capacity (e.g. garage door). In preferred embodiments, the opening defined between the side members 14, 16 of a completed door frame assembly is sufficient to receive a door having a width of at least 43 inches, with widths of at least 8 feet being more preferred. Door frame kits, and completed door frame assemblies of the invention are readily adapted to receive doors having widths of typical double garage doors such as 16 feet or 18 feet width. Greater widths are contemplated, especially where more robust metal extrusions 22 and/or substrates 30 are employed.

Figure 7:
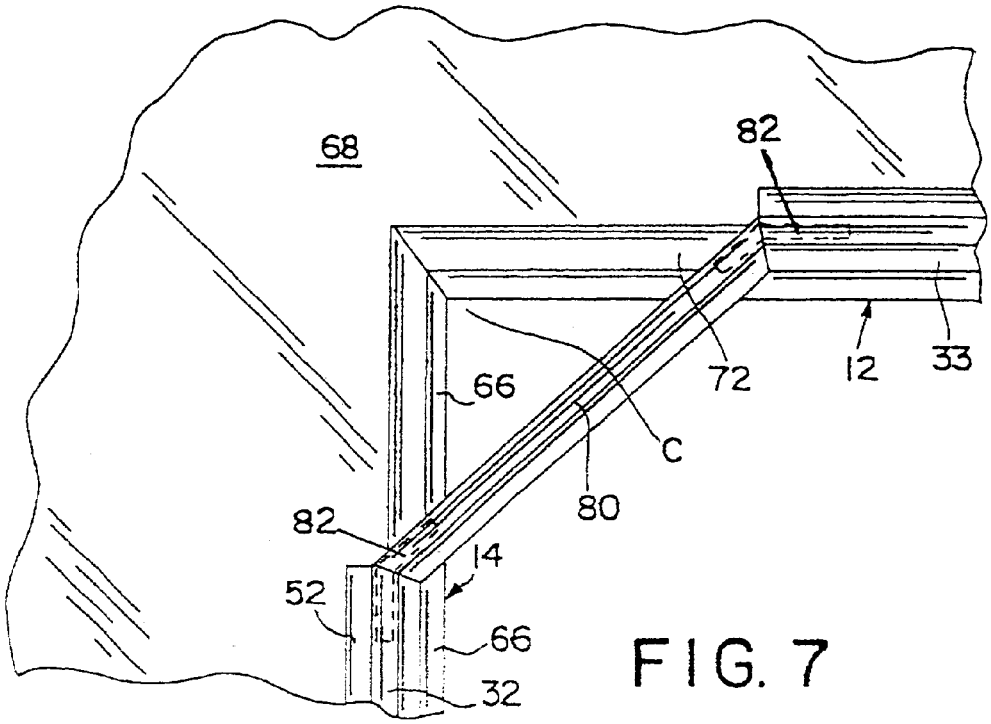
FIG. 7 shows an enlarged elevation of a top corner of a garage door assembly of the invention, employing a 45 degree corner.

In another embodiment illustrated in FIG. 7, gussets 80 extend across the left and right corners formed between top member 12 and side members 14, 16. At each such corner, a gusset 80, formed from a strip of the metal extrusion comprising frame molding 32 extends across the respective corner as shown in FIG. 7. Gussets 80 are secured to frame moldings 32 by gusset brackets 82. Gusset brackets 82 are channel-shaped metal extrusions which are friction-fitted into openings 84 in frame moldings 32 between surfaces 72 of the respective substrates 30 and front wall 86 of the respective frame moldings.

Frame moldings 32 on top member 12 and the respective side member extend only to the respective gusset 80, and do not cover substrate 30 or sheathing 70 between gusset 80 and the corner "C." Accordingly, surface 72 of substrate 30 is typically not covered or otherwise protected by any element of door frame assembly 54.

Substrate covers 34 and weather strip assemblies 56, however, extend the full lengths of the top member and the respective side members, including between gussets 80 and corners "C," thus protecting the surfaces of substrates 30 which face inwardly into the door opening.

While not shown in FIG. 7, as construction of the building progresses, siding which generally extends over outer surface 68 of sheathing 70, is emplaced so that it extends across surfaces 72 of substrates 30 and across the triangular openings formed between gussets 80 and the respective top and side members. The siding thus covers and protects surfaces 72, and closes off the triangular opening defined between surfaces 72 and gussets 80.

It is contemplated that the operation and functions of the invention have become fully apparent from the foregoing description of elements, but for completeness of disclosure, the usage of the invention will be briefly described.

For purposes of this example, it will be assumed that a two-piece metal extruded structure, as shown in FIG. 3, is being used, along with a weather strip assembly 56. Manufacture of top and side members of the door frame kit is first described. The dimensions (e.g. width and thickness) of the substrate material 30 are selected based on the size of the intended door frame (e.g. 9 foot wide opening, 72 inches in height, 6 inches deep). Groove 42 is formed in the substrate 30. Metal extruded structure, namely frame molding 32 as a first metal extrusion, and substrate cover 34 as a second metal extrusion, is designed and extruded based on the size and use of the intended door frame. Substrate 30 and the metal extrusions are cut to appropriate lengths. Interfacing ridges 36 are broken off and removed as necessary to adjust the width of substrate cover 34 to accommodate the width of the substrate 30 and placement of grooves 42. Inwardly turned lip 40 of substrate cover 34 is inserted into the respective groove 42, mounting the substrate cover to the substrate.

Frame molding 32 is mounted to substrate cover 34 and substrate 30, aligning frame molding 32 over, and locking frame molding 32 to, the outermost interfacing ridge 36 on the respective substrate cover, and interfacing side wall 24 with the respective surface of substrate 30, thus forming the extruded metal structure 22 as an integral unit on substrate 30, and securing the substrate 30 in the cavity 28 formed by the interiorly-facing side walls 24, 26 of the extruded metal structure 22. Substrate 30 is generally held in cavity 28 by frictional engagement between side,walls 24, 26 and the substrate. Such positioning is secured by the engagement of lip 40 in groove 42.

The inventors contemplate that other methods (than the frictional engagement) of holding substrate 30 in cavity 28 are readily available. And while assembling of a single top or side member has been described, multiple such top and side members can be readily assembled using the same or similar processes.

Typically, the contractor will receive the e.g. garage door frame kit 10 in disassembled condition. That is, the top and side members are assembled, but are separate elements of the kit, and are not joined to each other, as the kit is received. At this point, or during the manufacturing process, the top and side members are cut to length and the ends of the top member, and the ends of respective side members which will be mounted to the top member, are preferably cut at about 45 degree angles, or other appropriate angles, thus to enable forming mitered 90 degree joints, or other appropriate angled joints, when the side members are mounted to the top member.

The first side member 14 is positioned with respect to top member 12 using mounting screw 18, and is mounted to top member 12 with mounting screw 18.

Full secure mounting of side member 14 to top member 12 is then effected by installing screws 43. Screws 43 are significantly larger and more robust than screw 18, and provide the bulk of the structural joinder between side member 14 and top member 12.

The second side member 16 is positioned with respect to top member 12 using mounting screw 20, and is similarly secured to top member 12 with additional installing screws 43. At this point or later in the installation process, the joints formed between first and second side members 14, 16, and top member 12, are sealed with a sealing material effective to impede the intrusion of liquid, insects, and the like, into the joints. Preferred such sealing material is caulk.

Where gussets 80 are used, the gussets are typically installed before screws 18, 20, and 43 are installed.

Figure 6:
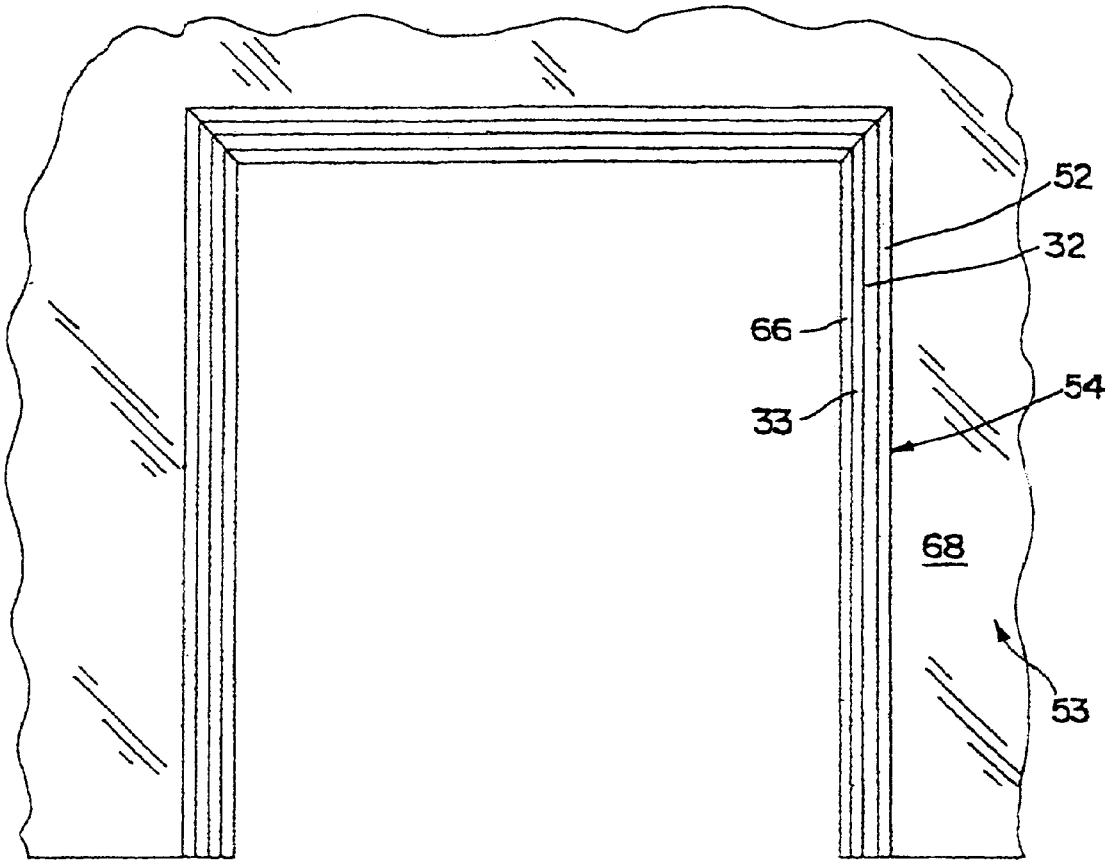
FIG. 6 shows the door frame kit of FIG. 1 assembled to make a door frame assembly, the door frame assembly being inserted into a garage door opening in a building.

The door frame assembly, as assembled above, is inserted into the door opening of the building in which the door frame assembly is to be installed as illustrated in FIG. 6. Positioning strips 52 on the extruded metal structures 22, which interface with outer surface of the members forming the door opening, aid in positioning the door frame assembly in the door opening, thereby positioning the door frame assembly relative to the door opening and aligning the door frame assembly with the outer wall of the building.

With the frame assembly thus located in the door opening, the door frame assembly is secured to the building at the door opening by driving nails, screws, or the like through the substrates, preferably the portions of the substrates 30 which extend outwardly of the cavities 28, and into the building elements which form the doorway rough opening in the building. Substrates 30 thus provide mounting loci for mounting the door frame assembly to the door opening. The fasteners can, if desired, pass through side wall 24 and/or 26. Any other effective fastening system can be used to secure the door frame assembly in the door opening.

The garage door is then hung in the garage door opening defined within the door frame.

Weather strip assemblies 56 are then mounted to the substrates 30 and, with the garage door closed, are adjusted for appropriate cooperative interaction with the garage door. Weather strip assemblies 56 cover those portions of the substrates 30 which extend from the extruded metal structures 22 and which would otherwise be exposed to the weather in a typical building installation. The combination of the extruded metal structures 22 and the weather strip assemblies 56 result in substantially complete coverage of those portions of the substrate which would otherwise be exposed to weather, thereby providing a maintenance-free door frame. Fastener cover 64 is then mounted to the weather strip assemblies 56 to enclose the channel 60.

The relationship between the finished door frame assembly and the door opening in the building is illustrated in FIGS. 3, 6, and 7. As seen there, positioning strip 52 interfaces with the outer surface 68 of sheathing 70 of the building. Screws 73 extend through substrate 30 and thus secure the frame assembly 54 to building frame member 74.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

Having thus described the invention, what is claimed is:

1. A door frame kit to be assembled into a door frame, said door frame kit comprising:

(a) a top member;

(b) a first side member; and (c) a second side member, said first and second side members compatible with of assembly to said top member thereby to fabricate a door frame therefrom for attachment to building members which define a door opening into which the door frame made with said kit can be inserted, said top and side members comprising elongate extruded metal structures having lengths corresponding substantially with the respective width and height of the door opening, an open edge being defined along the length of each of said extruded metal structures of said top and side members, and communicating with a corresponding cavity in the respective said extruded metal structure, each said cavity having a plurality of walls, including interiorly-facing side walls extending along the length of the respective said extruded metal structure, said first and second side members and said top member further comprising respective first, second, and third substrates received in the respective said cavities prior to assembly of said first and second side members to said top member, said substrates structurally reinforcing said extruded metal structures between said side walls along the lengths of said extruded metal structures prior to attachment of the door frame to building members, and the length of said top member defining an opening between said side members when said kit is assembled to make a door frame, the opening receiving a door having a width of at least 43 inches.

2. The door frame kit as in claim 1, said first and second side members being detached from said top member.

3. The door frame kit as in claim 1, said substrates comprising wood.

4. The door frame kit as in claim 1, a plurality of walls defining a cavity in at least one said extruded metal structure, and including at least one support web extending across said cavity, and effectively along the entire length of the respective extruded metal structure, structurally reinforcing the respective said extruded metal structure along the length thereof.

5. The door frame kit as in claim 1, the length of said top member being sufficient to enable the door frame to be used as a garage door frame.

6. The door frame kit as in claim 5, said extruded metal structures comprising extruded aluminum structures.

7. The door frame kit as in claim 6, said walls of said extruded metal structures having thicknesses of at least about 0.03 inch.

8. The door frame kit as in claim 5, said walls of said extruded metal structures having thicknesses of at least about 0.03 inch.

9. The door frame kit as in claim 5, said substrates providing mounting loci, outside said cavities, for mounting to a building, a door frame made with said door frame kit.

10. The door frame kit as in claim 5, said substrates substantially filling those portions of said cavities between the respective said opposing side walls.

11. The door frame kit as in claim 5, including positioning strips mounted to said extruded metal structures for interfacing with an outer surface of a member of an outer wall of a building in which the door frame is mounted, for thus positioning the door frame into a door opening of the building, thereby positioning the door frame relative to the door opening and aligning the door frame with the outer wall of the building.

12. The door frame kit as in claim 5, each said extruded metal structure comprising first and second metal extrusions cooperatively secured together to form said extruded metal structure.

13. The door frame kit as in claim 12, said first metal extrusion including breakaway portions, said breakaway portions allowing adjustment of the width of said first metal extrusion to accommodate the width of the respective said substrate.

14. A door frame kit as in claim 12, said first and second side members having respective first and second top ends, said top member having third and fourth opposing ends for joinder with said first and second top ends to form respective first and second corners of the door frame, said first metal extrusions in said first and second side members having respective fifth and sixth top ends displaced from said first and second top ends, said first metal extrusions in said top member having seventh and eighth opposing ends displaced from said third and fourth opposing ends, said first and second substrates extending from said fifth and sixth top ends, said third substrate extending from both of said seventh and eighth opposing ends, said door frame kit further comprising a first gusset for mounting to said first side member and said top member at said fifth and seventh ends of the respective said first metal extrusions, and a second gusset for mounting to said second side member and said top member at said sixth and eighth ends of the respective said first metal extrusions, said first and second side members and said top member thus being devoid of said first metal extrusions between said first and second corners and the respective said gussets.

15. The door frame kit as in claim 14, including gusset brackets for mounting said first and second gussets to said top member and said first and second side members, said gusset brackets frictionally engaging said gussets and respective said first metal extrusions on said top and side members.

16. A door frame assembly, comprising:

(a) a top member;

(b) a first side member mounted to said top member; and (c) a second side member mounted to said top member, said assembly being sized and configured for attachment to building members which define a door opening into which said door frame assembly can be inserted, said top and side members comprising elongate extruded metal structures having lengths corresponding substantially with the respective width and height of the door opening, an open edge being defined along the length of each of said extruded metal structures of said top and side members, and communicating with a corresponding cavity in the respective said extruded metal structure, each said cavity having a plurality of walls, including interiorly-facing side walls extending along the length of said extruded metal structures, said top and first and second side members further comprising substrates received in the respective said cavities prior to joining said first and second side members to said top member, said substrates structurally reinforcing said extruded metal structures between said side walls along the lengths of said extruded metal structures, said extruded metal structures comprising extruded aluminum structures.

17. The door frame assembly as in claim 16, the length of said top member being sufficient to enable said door frame assembly to be used as a garage door frame assembly.

18. The door frame assembly as in claim 16, said substrates comprising wood.

19. The door frame assembly as in claim 16, each said extruded metal structure including an interfacing lip, each said substrate including a groove, said interfacing lip being received in said groove, and thereby aiding in locating said substrate in said cavity.

20. The door frame assembly as in claim 16, including positioning strips mounted to said extruded metal structure for interfacing with an outer surface of a member of an outer wall of a building, for thus positioning said door frame assembly into the door opening of the building, thereby positioning said door frame assembly relative to the door opening and aligning said door frame assembly with the outer wall of the building.

21. The door frame assembly as in claim 16, said substrates substantially filling those portions of said cavities between the respective said side walls.

22. The door frame assembly as in claim 16, said substrates providing mounting loci for mounting said door frame assembly to a building.

23. The door frame assembly as in claim 16, the length of said top member defining an opening between said side members, the opening receiving a door having a width of at least 43 inches.

24. The door frame assembly as in claim 16, including weather strip assemblies mounted to said substrates and covering those portions of said substrates which extend from said extruded metal structures and which would otherwise be exposed to the weather in a typical building installation, the combination of said extruded metal structures and said weather strip assemblies resulting in substantially complete coverage of those portions of said substrates which would otherwise be exposed to weather thereby providing a maintenance-free door frame.

25. The door frame assembly as in claim 24, each said weather strip assembly comprising:

(a) an elongate mounting structure having a channel extending along the length of said mounting structure, said channel having interiorly-facing side walls and a back wall extending along the length of said mounting structure, said back wall providing a mounting locus for mounting said weather strip assembly to that portion of the respective said substrate which extends from said extruded metal structure;

(b) a fastener cover for mounting to said channel along the length of said channel to cover said channel and thereby enclose said channel to impede the intrusion of liquid into said channel and to impede visual observation of said channel; and (c) a sealing strip attached to said mounting structure, providing a weather seal between the door frame and a door mounted in the door frame.

26. The door frame assembly as in claim 16, each said extruded metal structure comprising first and second metal extrusions cooperatively secured together to form said extruded metal structure.

27. The door frame assembly as in claim 26, said first metal extrusion including breakaway portions, said breakaway portions allowing adjustment of the width of said first metal extrusion to accommodate the width of the respective said substrate.

28. A door frame kit to be assembled into a door frame, said door frame kit comprising:

(a) a top member;

(b) a first side member; and (c) a second side member, said first and second side members compatible with of assembly to said top member thereby to fabricate a door frame therefrom for attachment to building members which define a door opening into which the door frame made with said kit can be inserted, said top and side members comprising elongate extruded metal structures having lengths corresponding substantially with the respective width and height of the door opening, an open edge being defined along the length of each of said extruded metal structures of said top and side members, and communicating with a corresponding cavity in the respective said extruded metal structure, each said cavity having a plurality of walls, including interiorly-facing side walls extending along the length of the respective said extruded metal structure, said first and second side members and said top member further comprising respective first, second, and third substrates received in the respective said cavities prior to assembly of said first and second side members to said top member, said substrates structurally reinforcing said extruded metal structures between said side walls along the lengths of said extruded metal structures prior to attachment of the door frame to building members, and each said extruded metal structure including an interfacing lip, each said substrate including a groove, said interfacing lip being received in said groove, and thereby aiding in locating said substrate in said cavity.

29. A door frame kit to be assembled into a door frame, said door frame kit comprising:

(a) a top member;

(b) a first side member; and (c) a second side member, said first and second side members compatible with of assembly to said top member thereby to fabricate a door frame therefrom for attachment to building members which define a door opening into which the door frame made with said kit can be inserted, said top and side members comprising elongate extruded metal structures having lengths corresponding substantially with the respective width and height of the door opening, an open edge being defined along the length of each of said extruded metal structures of said top and side members, and communicating with a corresponding cavity in the respective said extruded metal structure, each said cavity having a plurality of walls, including interiorly-facing side walls extending along the length of the respective said extruded metal structure, said first and second side members and said top member further comprising respective first, second, and third substrates received in the respective said cavities prior to assembly of said first and second side members to said top member, said substrates structurally reinforcing said extruded metal structures between said side walls along the lengths of said extruded metal structures prior to attachment of the door frame to building members, said door frame kit further comprising weather strip assemblies mounted to said substrates and covering those portions of said substrates which extend from said extruded metal structures and which would otherwise be exposed to the weather in a typical building installation, the combination of said extruded metal structures and said weather strip assemblies resulting in substantially complete coverage of those portions of said substrates which would otherwise be exposed to weather thereby providing a maintenance-free door frame.

30. A door frame kit as in claim 29, each said weather strip assembly comprising:

(d) an elongate mounting structure having a channel extending along the length of said mounting structure, said channel having interiorly-facing side walls, and a back wall extending along the length of said mounting structure, said back wall providing a mounting locus for mounting said weather strip assembly to that portion of the respective said substrate which extends from said extruded metal structure;

(e) a fastener cover for mounting to said channel along the length of said channel to cover said channel and thereby enclose said channel to impede the intrusion of liquid into said channel and to impede visual observation of said channel; and (f) a sealing strip attached to said mounting structure, providing a weather seal between the door frame and a door mounted in the door frame.

31. A door frame assembly, comprising:

(a) a top member;

(b) a first side member mounted to said top member; and (c) a second side member mounted to said top member, said assembly being sized and configured for attachment to building members which define a door opening into which said door frame assembly can be inserted, said top and side members comprising elongate extruded metal structures having lengths corresponding substantially with the respective width and height of the door opening, an open edge being defined along the length of each of said extruded metal structures of said top and side members, and communicating with a corresponding cavity in the respective said extruded metal structure, each said cavity having a plurality of walls, including interiorly-facing side walls extending along the length of said extruded metal structures, said top and first and second side members further comprising substrates received in the respective said cavities prior to joining said first and second side members to said top member, said substrates structurally reinforcing said extruded metal structures between said side walls along the lengths of said extruded metal structures, said walls of said extruded metal structures having thicknesses of at least about 0.02 inch.

32. The door frame assembly as in claim 31, the length of said top member defining an opening between said side members, the opening receiving a door having a width of at least 43 inches.

33. The door frame assembly as in claim 31, each said extruded metal structure comprising first and second metal extrusions cooperatively secured together to form said extruded metal structure.

34. The door frame assembly as in claim 33, said first metal extrusion including breakaway portions, said breakaway portions allowing adjustment of the width of said first metal extrusion to accommodate the width of the respective said substrate.

* * * * *